US006752641B2

(12) United States Patent
Puri et al.

(10) Patent No.: US 6,752,641 B2
(45) **Date of Patent: *Jun. 22, 2004**

(54) CIRCUIT BOARD HAVING AN EMISSION REDUCING EJECTOR

(75) Inventors: Surrinder S. Puri, Schaumburg, IL (US); Dennis Strong, Sugar Grove, IL (US); Marc E. Krause, Darien, IL (US)

(73) Assignee: Tellabs Operations, Inc., Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/422,259

(22) Filed: Apr. 24, 2003

(65) Prior Publication Data

US 2003/0203667 A1 Oct. 30, 2003

Related U.S. Application Data

(63) Continuation of application No. 09/877,737, filed on Jun. 8, 2001, now Pat. No. 6,561,826.

(51) Int. Cl.[7] ..... H01R 13/62
(52) U.S. Cl. ..... 439/157; 439/95
(58) Field of Search ..... 439/157, 160, 439/152, 153, 155, 372, 95, 97, 101, 108

(56) References Cited

U.S. PATENT DOCUMENTS

| | | | | | |
|---|---|---|---|---|---|
| 4,313,150 | A | * | 1/1982 | Chu | 439/160 |
| 4,564,250 | A | * | 1/1986 | Klein et al. | 439/108 |
| 4,602,835 | A | * | 7/1986 | Bauer et al. | 439/160 |
| 5,386,346 | A | * | 1/1995 | Gleadall | 439/157 |
| 6,561,826 | B2 | * | 5/2003 | Puri et al. | 439/157 |

* cited by examiner

*Primary Examiner*—Renee Luebke
*Assistant Examiner*—Felix O. Figueroa
(74) *Attorney, Agent, or Firm*—McAndrews, Held & Malloy, Ltd.

(57) ABSTRACT

An electrical system comprises an electrical circuit board for mounting electrical components and a circuit board sub-rack. The board includes a pivotally mounted ejector member which pivots to insert and eject the board from the sub-rack. The ejector member carries two grounding contact surfaces for engagement with the ground plane of the board and chassis area of the sub-rack when the ejector member is pivoted to its closed position. The contact surface of the ejector member mates with the board to frictionally hold the board in fully inserted position. The ejector member also includes a retaining arm which mates with the sub-rack for providing an insertion or ejection force to facilitate insertion or ejection of the board relative to the sub-rack.

20 Claims, 2 Drawing Sheets

FIG. 1
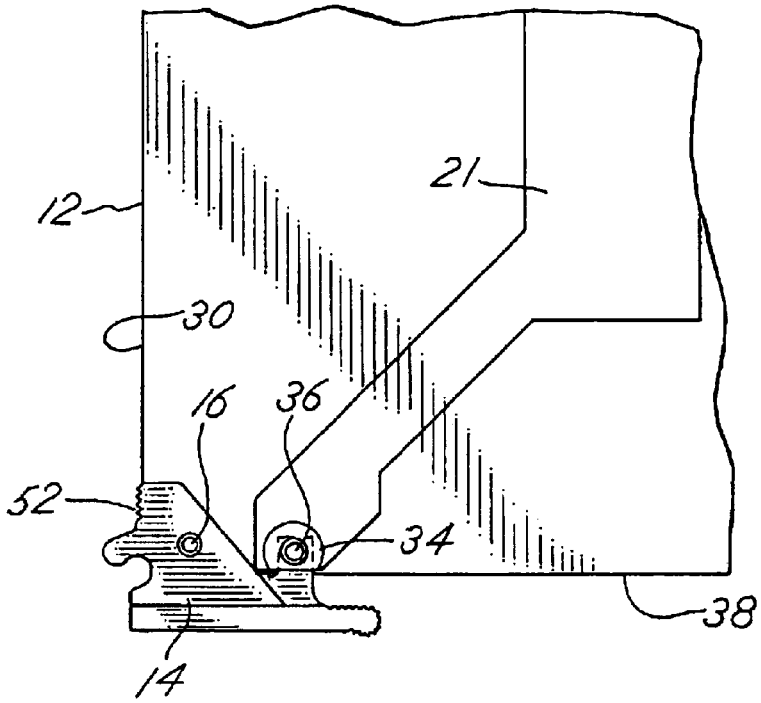
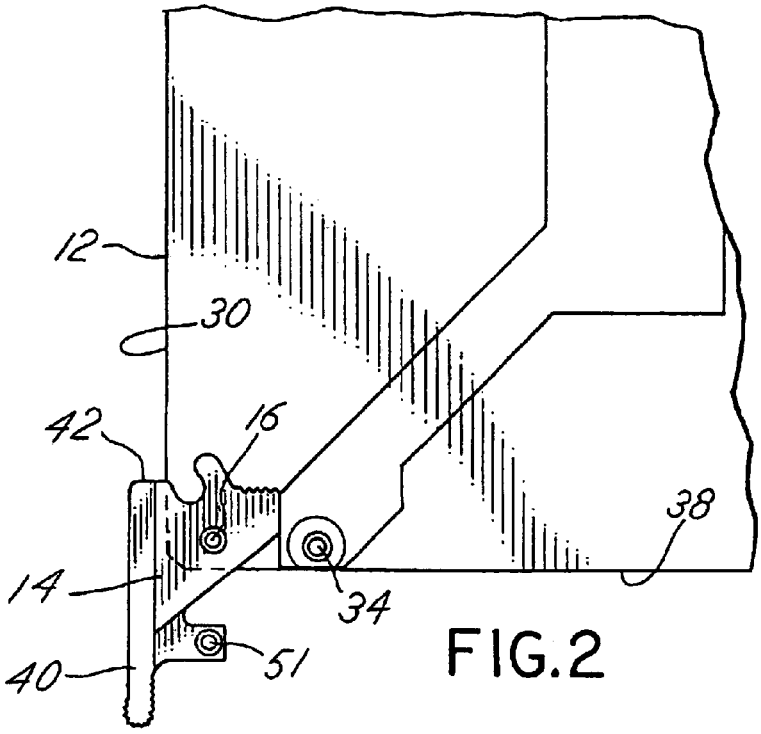
FIG. 2

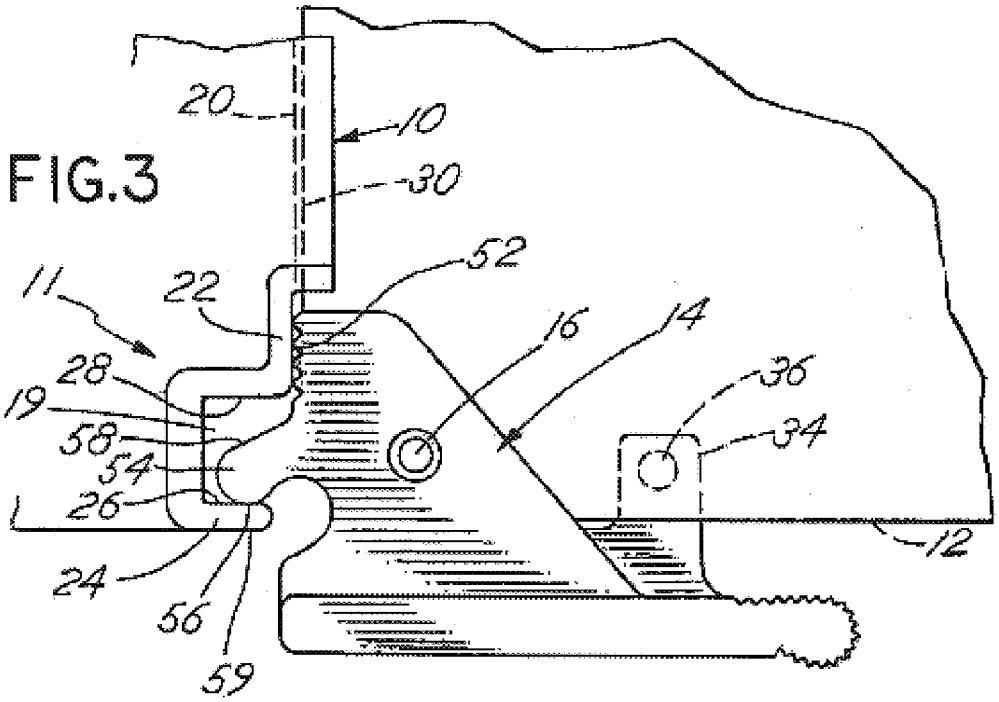
FIG.3
FIG.4
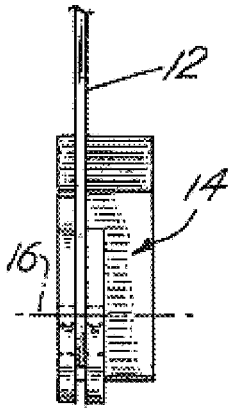
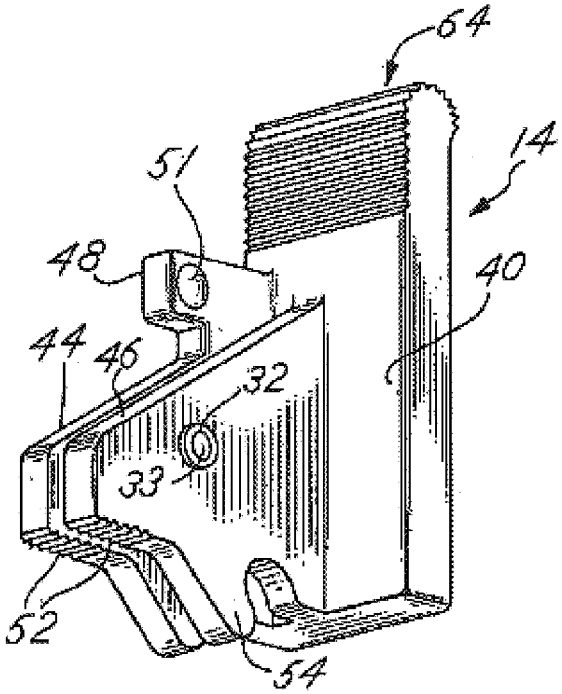
FIG.5
FIG.6
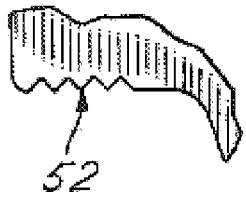

CIRCUIT BOARD HAVING AN EMISSION REDUCING EJECTOR

CROSS-REFERENCE TO RELATED APPLICATIONS

This is a continuation of U.S. application Ser. No. 09/877,737, filed Jun. 8, 2001, now U.S. Pat. No. 6,561,826, incorporated by reference in its entirety.

STATEMENT REGARDING FEDERALLY SPONSORED RESEARCH OR DEVELOPMENT

Not Applicable

BACKGROUND OF THE INVENTION

The present invention generally relates to an emission reducing ejector for an electrical system, and more particularly, to an ejector for an electrical system that both ejects the electrical circuit board and provides enhanced shielding of the electrical system.

Typically, electrical systems make use of electrical circuit boards, such as printed circuit boards, to perform various functions. The boards support electrical components and provide for electrical connection into the system. Additionally, the boards may be used to distribute heat dissipation, for modularity and ease of replacement.

Printed circuit boards are typically mounted onto shelves and/or sub-racks. The circuit boards are slid into the sub-rack and interfaced to the system via an electrical connector. Removal of a board may be difficult where the board is closely spaced to another board, or where the printed circuit board has become fused to the connector, or where internal friction with the connector impedes removal.

Another problem with these systems is that the circuit boards are often insufficiently shielded. This results in electromagnetic emissions, which may cause electrical interference. Further, the boards may become more susceptible to outside influences including static discharge transients, and electromagnetic fields generated by other equipment. These problems are exacerbated when multiple printed circuit boards are used together in sub-racks.

Thus, there is a need for an improved circuit board that facilitates easy removal from an electrical system as well as provides sufficient shielding of the system to reduce the electronic emissions, and susceptibility to electrostatic discharge, transients, and external electromagnetic fields.

BRIEF SUMMARY OF THE INVENTION

It is therefore an object of the present invention to provide an improved circuit board.

It is a further object of the present invention to provide an improved circuit board and sub-rack for housing the improved circuit board.

It is a further object of the present invention to provide improved shielding between a circuit board and its associated sub-rack.

It is yet another object of the present invention to provide ejection apparatus that facilitates ejection of a circuit board from its associated sub-rack.

It is yet another object of the present invention to provide insertion apparatus that facilitates insertion of a circuit board into its associated sub-rack.

These and other objects of the present invention are achieved in a circuit board having an ejector member which pivots relative to the board so as to perform either one or all of an ejection function, an insertion function and a shielding function. An associated sub-rack is configured to cooperate with the ejector member.

In one embodiment, the ejector comprises contact areas which engage during insertion or ejection of the board from the sub-rack. The ejector comprises contact areas which electrically mate with the board and the sub-rack.

BRIEF DESCRIPTION OF THE DRAWINGS

FIG. 1 is a partial plan view of an ejector member in its closed position relative to a printed circuit board, in accordance with an embodiment of the present invention.

FIG. 2 is a partial plan view of the ejector member of FIG. 1, shown in its open position relative to the printed circuit board.

FIG. 3 is a partial enlarged view of the ejector member and board of FIG. 1, shown positioned in a sub-rack.

FIG. 4 is a partial end view of the ejector member and print circuit board of FIG. 1.

FIG. 5 is a perspective view of the ejector member of FIG. 1.

FIG. 6 is a partial top view of the ejector member of FIG. 1.

DETAILED DESCRIPTION OF THE PREFERRED EMBODIMENT

The foregoing summary, as well as the following detailed description of the preferred embodiment of the present invention, will be better understood when read in conjunction with the appended drawings. It should be understood, however, that the present invention is not limited to the precise arrangements and instrumentalities shown in the attached drawings.

Referring to FIG. 1, an ejector member 14 is pivotally mounted to the corner of a printed circuit board 12. FIG. 1 shows ejector member 14 in its closed position relative to board 12. FIG. 2 shows ejector member 14 in an open position relative to board 12. Between these two positions, ejector member 14 pivots on an axis 16.

As shown in FIG. 3, circuit board 12 is housed in a sub-rack 10. Sub-rack 10 includes a pair of board receiving grooves 20 (one shown) extending the depth of the sub-rack for receiving each of the two lateral edges 30 (one shown) of printed circuit board 12. The sub-rack 10 may include a number of pairs of receiving grooves for housing a plurality of circuit boards. Additionally, a number of such sub-racks may be used in the electrical system.

The two board receiving grooves 20 are configured and aligned in rack 10 so as to provide a stable engagement with the two lateral edges 30 of circuit board 12 so as to hold the board in place after its electrical connection to the system. In addition, the two grooves 20 permit the board to be easily slid into and out of the sub-rack.

The sub-rack 10 is configured at its board entry area 11 to mate with the ejector 14. A laterally extending cavity 19 is shaped to receive a portion of the ejector member. Cavity 19 is defined by a chassis contact area 22 located near the board receiving groove 20 for making electrical and mechanical contact with one surface of ejector 14. In addition, a second surface 26 and a third surface 28 are positioned for engaging ejector member 14 during times in its pivotal movements, as described hereinafter. In the illustrated embodiment, the second surface 26 and the third surface 28 are flat surfaces disposed substantially parallel to one another.

Referring again to FIG. 1, the circuit board 12 comprises electrical components (not shown) as well as a ground plane 21. Preferably, the board 12 is a printed circuit board. Alternatively, a different type of circuit board or a wire board could be used. A grounding contact area 34 is electrically connected to ground plane 21 and is located on board 12 for engaging a portion of the ejector member when the ejector member is in its closed position. In the illustrated embodiment, the grounding contact area 34 is, or includes, a grounding hole 36. Hole 36 passes through the board and is coated with electrically conductive material, both inside the board and surrounding its outer periphery on the face of the board.

Additionally, the board comprises a front end 38 and a back end (not shown). The back end of the circuit board 12, has the deepest entry into sub-rack 10 and locates an electrical connector (not shown) positioned on the board in order to connect the circuit board 12 to the system. The board receiving grooves 20 guide each lateral edge of the circuit board 12 as it is inserted and slid into sub-rack 10.

Referring to FIG. 5, ejector member 14 comprises a cylindrical pivot hole 32 which defines axis 16. A cylindrical pin 33 passes through hole 32 in the ejector member and through a hole in the printed circuit board. The pin 33 is connected at each of its ends to ejector member 14 and is sized to permit the ejector member to pivot freely relative to the board.

The ejector member 14 acts to provide a connection between the circuit board ground 12 and the sub-rack chassis 10. To accomplish this, the ejector member 14 is made from a conductive material, such as aluminum A380. A grounding contact 51 (FIG. 5) is located on the ejector member for making contact with grounding area 34 (FIG. 1) of circuit board 12. In addition, a second contact area 52 on the ejector member is located for making electrical contact with area 22 (FIG. 3) on the sub-rack 10.

Ejector member 14 provides for extraction of the circuit board 12 from the sub-rack 10. Referring to FIG. 3, the clockwise pivoting of ejector member 14 from its closed position and toward its open position causes an ejector surface 58 to contact a surface 28 of sub-rack 10 forcing board 12 out of the sub-rack. Thus, the ejector member 14 is mounted at the front end 38 of the circuit board 12. As understood, a separate ejector member may be located at each of the two front corners of the board.

Referring to FIG. 5, the ejector member 14 comprises a base 40 and a pair of parallel spaced flanges 44, 46. Flanges 44, 46 extend perpendicularly to base 40 and are spaced apart for receiving board 12. When ejector member 14 is mounted onto circuit board 12, the circuit board is interposed between flanges 44, 46.

A grounding contact arm 48 extends from the base 40 of the ejector member and locates a contact 51 in a position for mating with the contact hole 36 of the board when the ejector member is in its closed position. Contact arm 48 is substantially coplanar with flange 44, as shown in FIG. 5. As will suggest itself, grounding contact arm 48 may be alternatively coplanar with the flange 46. Further, two or more grounding contact arms may be used to contact both ends of contact hole 36.

In the illustrated embodiment, grounding contact 51 is a raised button which has its outer surface configured so as to be accepted into the grounding hole 36 of the board. Contact 51 frictionally engages the board as it is moved toward hole 36 and biases the contact so that it snaps into grounding hole 36 of the board. Hole 36 frictionally retains contact 51, and thus the ejector member, until a sufficient force pivots the ejector member away from contact hole 36.

As shown in FIG. 5, ejector 14 comprises a pair of rack contact areas 52. Contact areas 52 are located on edge surfaces of flanges 44, 46, and are configured with a plurality of groove configurations as shown in more detail in FIG. 6. Contact areas 52 make contact with the chassis contact area 22 (FIG. 3) of sub-rack 10 when the circuit board 12 is inserted into the rack and ejector member 14 is pivoted to its closed position.

As will suggest itself, contact area 52 may be located on only one of flanges 44, 46 or at a different location on the ejector 14. Contact area 52 is located so as to engage a conductive metal surface on the sub-rack when the ejector 14 is in its closed position. In the embodiment, the conductive metal surface is formed by the cavity forming member 24 (FIG. 3).

Referring again to FIG. 5, ejector 14 comprises at least one retaining arm 54. In the illustrated embodiment, two retaining arms 54 extend from and each are substantially coplanar with a flange 44, 46. As indicated in FIG. 3, each retaining arm 54 includes a front surface 56 and a rear surface 58. The front surface 56 faces outwardly from sub-rack 10, while the rear surface 58 faces inwardly of the sub-rack. Front surface 56 cooperates with surface 26 of the sub-rack cavity forming member 24 to maintain the circuit board 12 inside the sub-rack 10. As the ejector member is pivoted counter clockwise to its closed position, surface 56 engages surface 26 providing a forward force at pivot axis 16 which drives the board back into the sub-rack. As the ejector member continues its counter clockwise movement, contact button 51 snaps into the contact hole 56 which frictionally latches the ejector member into its closed position. There is no mechanical interference as the ejector 14 rotates relative to the circuit board 12 and sub-rack 10, except at the contact areas 26, 28 and 34.

Referring again to FIG. 5, base 40 of ejector 14 further comprises a finger tab 64. Finger tab 64 is located distally from pivot axis 16. The more distant the finger tab 64 is from the pivot axis, the greater the mechanical advantage to facilitate moving the ejector 14 from its open and closed positions. The operator applies manual force at finger tab 64 to eject and insert the board relative to the sub-rack.

As shown in FIG. 1, base 40 of the ejector member is substantially parallel to the front edge 38 of the circuit board 12. This position is referred to herein as the closed position. To remove the board from the sub-rack, the user places his or her thumbs on finger tab 64 and rotates ejector member 14 approximately 90° clockwise about pivot axis 16. In this position (shown in FIG. 2) the base 40 is substantially parallel to the lateral edge 30 of the board, and the grounding contact 51 of the ejector member is no longer in contact with the grounding contact 34 of the circuit board 12. This is referred to herein as the open position.

The circuit board 12 is inserted back-end-first into the sub-rack 10. The circuit board 12 is positioned so that the lateral edges 30 are aligned with the board receiving grooves 20, and the board 12 is then slid into the sub-rack 10. For installation of the board 12 into the sub-rack 10, the ejector member 14 should be in the open position (FIG. 2). If the ejector member 14 is in the closed position, the rear surface 58 (FIG. 3) of retaining arm 54 will mechanically interfere with the front edge 59 of the sub-rack as the circuit board 12 slides into the sub-rack 10. This prevents complete insertion of the circuit board 12 into the sub-rack 10, and alerts the user by its forward position that the ejector must be rotated.

With the ejector 14 in the open position, the following sequence of events occurs as the circuit board 12 is inserted into the sub-rack 10. As the circuit board 12 slides along the board receiving groove 20, eventually the edge 42 (FIG. 2) of the ejector member comes into contact with the cavity member 24 of the sub-rack. This contact urges the ejector 14 to rotate counter-clockwise (as viewed in FIG. 1) about pivot axis 16. As the board 12 further enters the sub-rack 10 and ejector 14 continues to rotate, retaining arm 54 swings clear of second retaining surface 28 and enters the cavity 19 bounded by surfaces 26, 28. Finally, a force applied to finger tab 64 completes the insertion. The back end of the circuit board 12 is now mated with its connector (not shown), and the button 51 of the ejector 14 is engaged with the grounding hole 36 of the circuit board 12. The ejector member 14 enters its closed position.

With the ejector 14 in its closed position and the circuit board 12 fully inserted into the sub-rack, the button 51 of the ejector member is engaged with the grounding hole 36 of the board, and the contact area 52 of the ejector member is in contact with the contact area 22 of the sub-rack as shown in FIG. 1. The ground plane of the circuit board 12 is thereby connected to the sub-rack 10. Thus, the circuit board 12 provides an electrical path between the circuit ground plane and the sub-rack at the front of the circuit board 38, reducing electromagnetic emissions and susceptibility to electrostatic discharge, transients, and radiated electromagnetic fields. Further, the engagement of the button 51 with the grounding hole 36 not only facilitates shielding, but provides a frictional retaining force to help maintain ejector 14 in its closed position. The rear surface 56 of the retaining arm 54 of the ejector cooperates with retaining surface 26 of the sub-rack to help prevent the board 12 from sliding out of the sub-rack 10 while the ejector 14 is in the closed position.

To remove the board 12 from the sub-rack 10, a force is applied to finger tab 64. As viewed in FIG. 1, the removing force urges the ejector 14 to rotate clockwise about pivot axis 16. The button 51 is disengaged from the grounding hole 36 and ejector member 14 rotates clockwise. The edge 58 of the retaining arm 54 of the ejector comes into contact with the ejecting contact surface 28 of sub-rack 10. This interference causes any further relative rotation between the board 12 and ejector member 14 to be accompanied by movement of the board 12 out of the sub-rack 10. Thus, as an opening force continues to be applied to the finger tab 64, the board 12 slides out of the sub-rack 10. Once ejector member 14 has rotated into its open position, the retaining arm 54 is no longer constrained by first retaining surface 26, and the board 12 may be slid completely out of the sub-rack 10.

Thus, the present invention provides for easy insertion and removal of a circuit board from an electrical system as well as shielding to reduce electromagnetic emissions and susceptibility to electrostatic discharge, transients, and radiated electromagnetic fields.

While particular elements, embodiments, and applications of the present invention have been shown and described, it will be understood, of course, that the invention is not limited thereto since modifications may be made by those skilled in the art, particularly in light of the foregoing teachings. It is therefore contemplated by the appended claims to cover such modifications and incorporate those features that come within the spirit and scope of the invention.

What is claimed is:

1. A board for an electrical system having a sub-rack to receive the board, the sub-rack having a chassis contact area, the board comprising:

a circuit;

a first grounding contact area electrically connected to the circuit; and a member mounted to the board, said the member movable to an open position and a closed position, the member including a second grounding contact area to contact with the first grounding contact area of the board when the member occupies the closed position and a third grounding contact area to contact with the chassis contact area when the board is inserted into the sub-rack and the member occupies the closed position.

2. The board of claim 1 wherein the member is mounted to enable an operator to move the member between the open position and the closed position when the board is inserted into or ejected from the sub-rack.

3. The board of claim 1 comprises a printed circuit board having the circuit.

4. The board of claim 1 wherein the circuit includes a ground plane, and the first grounding contact area is electrically connected to the ground plane.

5. The board of claim 1 wherein the member further includes an ejection surface to engage the sub-rack to eject the board from the sub-rack upon movement of the member to the open position.

6. The board of claim 1 wherein the member further includes a retaining surface to engage the sub-rack to retain the board in the sub-rack upon movement of the member to the closed position.

7. The board of claim 6 wherein the member further includes an ejection surface to engage the sub-rack to eject the board from the sub-rack upon movement of the member to the open position.

8. The board of claim 1 wherein the member is pivotally mounted to the board, and the member is pivotable to the open position and the closed position.

9. A board for an electrical system having a sub-rack to receive the board, the sub-rack having a chassis contact area, the board comprising:

an electrical component;

a first grounding contact area; and a member mounted to the board, the member movable to an open position and a closed position, and the member including a second grounding contact area to contact with the first grounding contact area of the board when the member occupies the closed position and a third grounding contact area to contact with the chassis contact area when the board is inserted into the sub-rack and the member occupies the closed position.

10. The board of claim 9 is a circuit board or a wire board.

11. The board of claim 9 further comprises a ground plane.

12. The board of claim 11 wherein the first grounding contact area is electrically connected to the ground plane.

13. The board of claim 9 wherein the member further includes an ejection surface to engage the sub-rack to eject the board from the sub-rack upon movement of the member to the open position.

14. The board of claim 9 wherein the member further includes a retaining surface to engage the sub-rack to retain the board in the sub-rack upon movement of the member to the closed position.

15. The board of claim 14 wherein the member further comprises an ejection surface to engage the sub-rack to eject the board from the sub-rack upon movement of the member to the open position.

16. The board of claim 9 wherein the member is mounted to enable an operator to move the member between the open position and the closed position when the board is inserted into or ejected from the sub-rack.

17. The board of claim 9 wherein the member is pivotally mounted to the board, and the member is pivotable to the open position and the closed position.

18. A board for an electrical system having a sub-rack to receive the board, the sub-rack having a chassis contact area, the board comprising:

an electrical component;

a ground plane;

a first grounding contact area electrically connected to the ground plane; and a member mounted to the board, the member moveable to an open position and a closed position, the member including a second grounding contact area to contact with the first grounding contact area of the board when the member occupies the closed position and a third grounding contact area to contact with the chassis contact area when the board is inserted into the sub-rack and the member occupies the closed position.

19. The board of claim 18 wherein the member further comprises an ejection surface to engage the sub-rack to eject the board from the sub-rack upon movement of the member to the open position.

20. The board of claim 18 wherein the member further comprises a retaining surface to engage the sub-rack to retain the board in the sub-rack upon movement of the member to the closed position.

* * * * *

UNITED STATES PATENT AND TRADEMARK OFFICE

CERTIFICATE OF CORRECTION

PATENT NO. : 6,752,641 B2
DATED : June 22, 2004
INVENTOR(S) : Surrinder S. Puri et al.

It is certified that error appears in the above-identified patent and that said Letters Patent is hereby corrected as shown below:

Column 6,
Line 4, delete the word "said".

Signed and Sealed this

First Day of February, 2005

JON W. DUDAS
*Director of the United States Patent and Trademark Office*